US005163595A

United States Patent [19]

Messner

[11] Patent Number: 5,163,595

[45] Date of Patent: Nov. 17, 1992

[54] INTERMITTENT FEEDING OF A WEB-SHAPED WORKPIECE

[75] Inventor: Helmut Messner, Arbon, Switzerland

[73] Assignee: Bruderer AG, Frasnacht, Switzerland

[21] Appl. No.: 830,758

[22] Filed: Feb. 5, 1992

Related U.S. Application Data

[63] Continuation of Ser. No. 515,237, Apr. 27, 1990, abandoned.

[30] Foreign Application Priority Data

May 3, 1989 [CH] Switzerland ..... 1693/89

[51] Int. Cl.[5] ..... B65H 20/00

[52] U.S. Cl. ..... 226/154; 226/149; 226/160

[58] Field of Search ..... 226/147, 148, 149, 152, 226/154, 160, 158

[56] References Cited

U.S. PATENT DOCUMENTS

| | | | |
|---|---|---|---|
| 2,946,586 | 7/1960 | Pityo | 271/2.4 |
| 3,758,011 | 9/1973 | Portmann | 226/142 |
| 4,601,420 | 7/1986 | Kato | 226/154 |

FOREIGN PATENT DOCUMENTS

| | | |
|---|---|---|
| 253205 | 1/1988 | European Pat. Off. . |
| 917975 | 1/1947 | France . |
| 2290972 | 11/1975 | France . |

*Primary Examiner*—Daniel P. Stodola
*Assistant Examiner*—Paul Bowen
*Attorney, Agent, or Firm*—Ladas & Parry

[57] ABSTRACT

Pivot arms which carry the pressing bar are hingedly mounted to the rocker. At their opposite ends these pivot arms are hingedly mounted such to the frame that in one position the axis of rotation of the lower feeding roller coincides with the pivotal axis of the pivotal point at which the pivot arms are hingedly mounted to the frame. The pressing bar is thereby hingedly mounted via a link connection to a pivot point at the frame that a parallelogram of movements is provided, based on which the pressing bar is moved exactly perpendicularly against the workpiece to be arrestingly pressed.

1 Claim, 2 Drawing Sheets

INTERMITTENT FEEDING OF A WEB-SHAPED WORKPIECE

This is a continuation of copending application Ser. No. 07/515,237 filed on Apr. 27, 1990, now abandoned.

BACKGROUND OF THE INVENTION

The present invention relates to an apparatus for intermittently feeding a web-shaped workpiece.

One such apparatus has a pressing roller operative to exert periodically a pressure onto the workpiece, which pressing roller is rotatably supported in a rocker at a location intermediate the ends thereof, and an oscillatingly driven feeding member cooperating with said pressing roller. The pressing roller and feeding member receive the web-shaped workpiece between themselves. An arresting device is operative to temporarily press the web-shaped workpiece between respective feeding steps against a stationary member to arrest the workpiece.

Such an apparatus is disclosed in the Swiss patent application no. 3984/88-1, in which apparatus the pressing bar 46 is fixedly mounted to the pivot arms 13, 14. This structure is illustrated, for instance, in FIG. 2 of mentioned patent application.

Conclusively, the pressing bar moves along a part of a circular line towards the web-shaped workpiece to be pressed such that an impeccable planar contact between the pressing bar 45 and the workpiece 43 is not always obtained.

SUMMARY OF THE INVENTION

It is, accordingly, a general object of the invention to provide an apparatus for an intermittent feeding of a web-shaped workpiece, in which the pressing bar will press not with a line contact against the workpiece but rather with a planar surface contact.

A further object of the present invention is to provide an apparatus for an intermittent feeding of a web-shaped workpiece, in which a rocker is hingedly mounted at one end to an oscillatingly movable link member operative to drive the rocker and supported on a first spring, at the opposite end supportable on a supporting member and supported on a further spring, and in which the arresting device comprises a pressing bar located between two pivot arms, which pivot arms are at one end hingedly mounted to the rocker and at the other end to a part of the frame of the apparatus at a point in which their pivot axis coincides at a rocking position of the rocker at least approximately with the axis of rotation of the pressing roller supported in the rocker, further in which the pressing bar is hingedly mounted via an intermediate carrier to pivot arms hingedly mounted via link members at a respective pivotal point to the frame which is located on a straight line extending perpendicularly to the plane of feed of the workpiece and through the axis of rotation of the upper pressing roller when located in its pressing position, and which straight line extends parallel to a further straight line extending through the two pivotal points at which the intermediate carrier is hingedly mounted to the pivot arms and to the link members, respectively.

BRIEF DESCRIPTION OF THE DRAWINGS

The present invention will be better understood and objects other than those set forth above will become apparent when consideration is given to the following detailed description thereof. Such description makes reference to the annexed drawing, wherein.

DESCRIPTION OF THE PREFERRED EMBODIMENT

Figure 1:
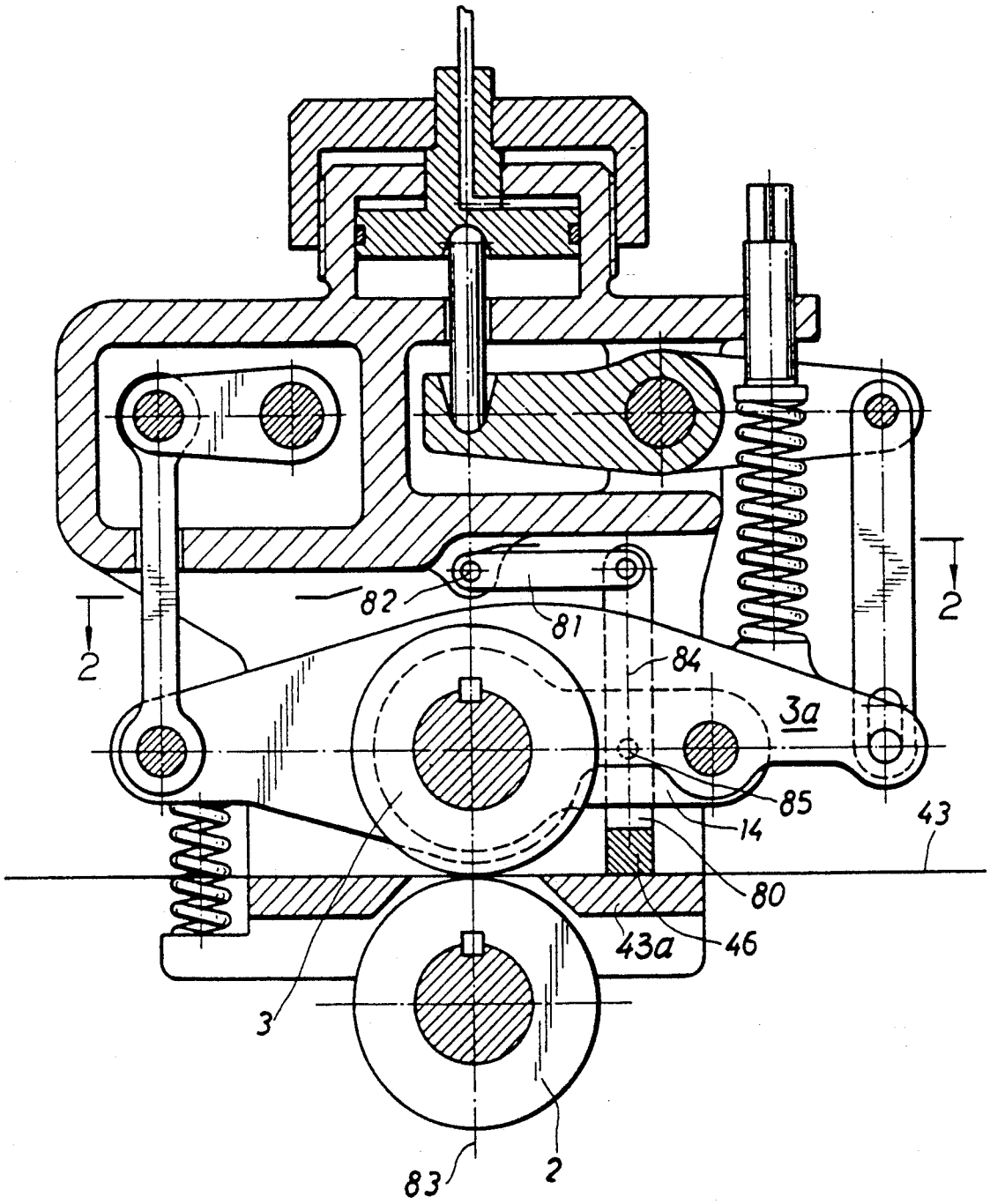
FIG. 1 illustrates an asymmetric cross-sectional elevational of a symmetrical embodiment of the present invention.
Figure 2:
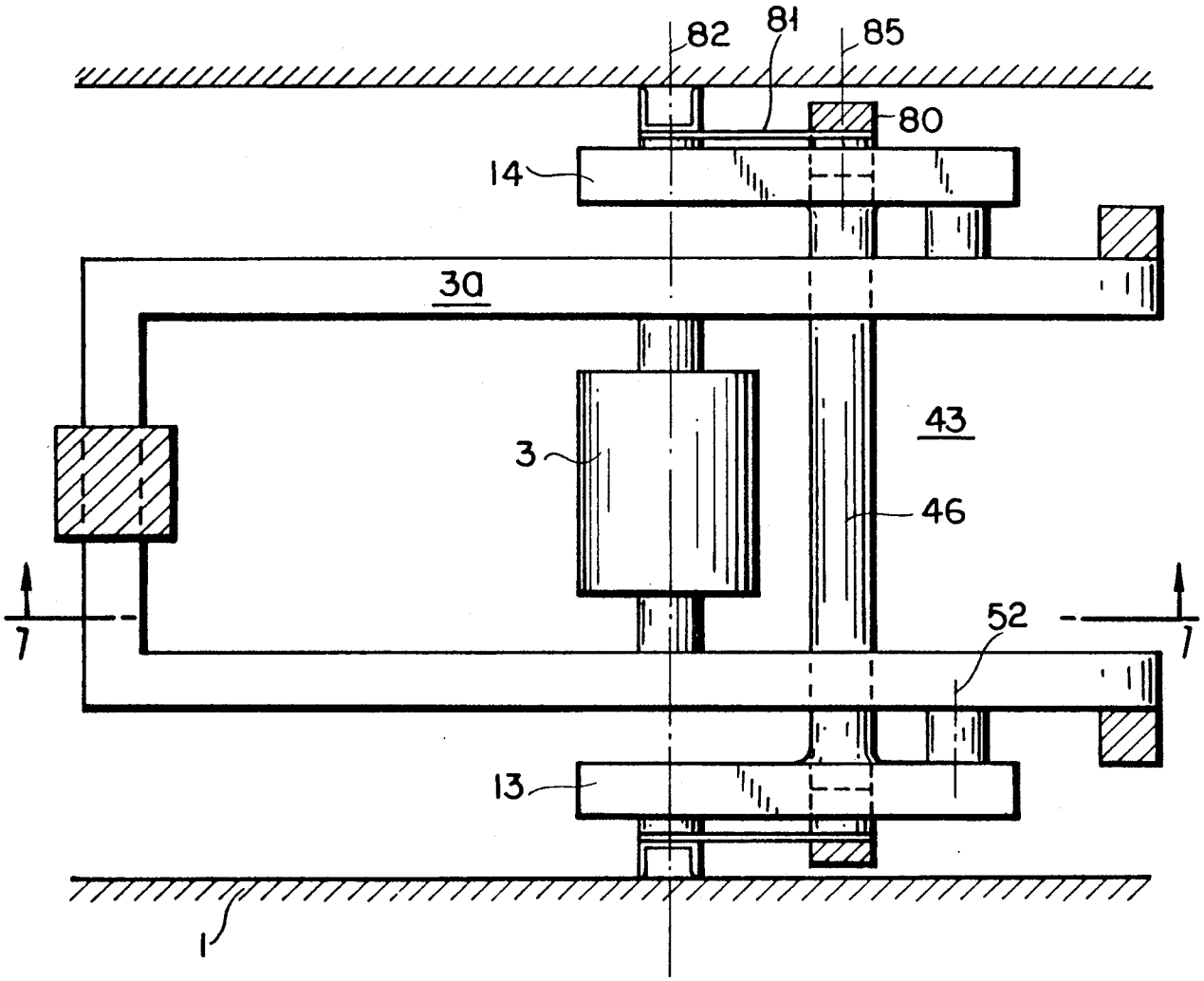
FIG. 2 is a plan schematic of portions thereof.

For sake of clarity only those reference numerals are entered in the figure which are necessary for the understanding of the present invention. Further, those structural members which are disclosed in the figures of the Swiss patent application no. 3984/88-1 and specifically in FIG. 2 thereof are identified by the same respective reference numerals.

The pressing bar 46 has a rectangular or, specifically, square cross section. The pressing bar 46 is rigidly mounted to one end of an intermediate carrier 80 or integrally made therewith, which intermediate carrier 80 can consist e.g. of two parallel carrier rods. Each rod of the intermediate carrier 80 is hingedly mounted at a pivotal point 85 intermediate its ends to pivot arms 13, 14 intermediate its ends. One end of each pivot arm is pivoted on a rocker 3*a* and the opposite end on a frame 1. The opposite end of the intermediate carrier 80 is hingedly mounted at a pivotal point to one end of link members 81. The opposite end of each link member 80 is, in turn, hingedly mounted to the frame of the apparatus at a pivotal point 82. Each pivotal point 82 of the link members 81 to the frame is located at a straight line 83, which extends through the axis of rotational support of an upper feeding or pressing roller 3 intermediate ends of the rocker 3*a* when the rocker has positioned the pressing roller in its pressing position and perpendicularly to a stationary plane member 43*a* for the feeding of the web-shaped workpiece 43. The upper pivotal point of each rod of the intermediate carrier 80, at which it is linked to the link members 81 and the lower pivotal point 85, at which it is linked to the pivot arms 13, 14, are located on a further straight line 84, which extends parallel to the first mentioned straight line 83. Accordingly, a parallelogram-like arrangement is provided, in which the pressing bar 46 moves during the pivotal movements of the pivot arms 13, 14 oscillatingly along a straight line extending perpendicularly to the plane of feed of the web-shaped workpiece 43, whereby a rectilinear movement of the pressing bar 46 against the workpiece to be pressingly arrested and away therefrom is arrived at. This kind of movement guarantees an impeccable pressing of the pressing surface of the pressing bar 46.

While there is shown and described a present embodiment of the invention, it is to be distinctly understood that the invention is not limited thereto, but may be otherwise variously embodied and practiced within the scope of the following claim.

I claim:

1. In an apparatus for feeding a web-shaped workpiece in intermittent feeding steps, the apparatus having a pressing roller operative to exert pressure onto the web-shaped workpiece during the intermittent feeding steps, opposite ends of the pressing roller being supported on a rocker rotatably about an axis at a location intermediate the ends of the rocker, an oscillatingly driven feeding member that cooperates with the pressing roller such that the pressing roller and feeding member receive the web-shaped workpiece between themselves for the intermittent feeding steps, and an arresting device operative to temporarily press the web-shaped workpiece between the intermittent feeding steps against a stationary plane member to arrest the intermittent feeding steps of the web-shaped workpiece, the improvement in which the arresting device comprises:

a pressing bar for the temporary pressing of the web-shaped workpiece;

two pivot arms, each pivot arm being hingedly mounted at one end to the rocker and at its opposite end at a pivot axis to a part of a frame at a point at which the pivot axis coincides at a rocking position of the rocker at least approximately with the axis of the rotatable support of the pressing roller on the rocker;

two link members each having opposite first and second ends, the first end of each link member being hinged to the frame about a first pivotal point; and an intermediate carrier connected to the pressing bar at one end, hinged to the second ends of the link members about second pivotal points at an opposite end, and hinged to the pivot arms at third pivotal points intermediate its ends;

each first pivotal point being located on a first straight line extending perpendicularly to the plane member and through the axis of rotation of the pressing roller during the intermittent feeding steps when the web-shaped workpiece is received between the pressing roller and feeding member, a second straight line extending parallel to the first straight line and through the second and third pivotal points, whereby the pressing bar moves at least approximately perpendicularly to the plane member for the temporary pressing of the web-shaped workpiece thereon.

* * * * *